US005496183A

United States Patent [19]

Soes et al.

[11] Patent Number: 5,496,183

[45] Date of Patent: Mar. 5, 1996

[54] PRESTRESSED SHIELDING PLATES FOR ELECTRICAL CONNECTORS

[75] Inventors: Lucas Soes, Rosmalen; Petrus R. M. van Dijk, 's-Hertogenbosch, both of Netherlands

[73] Assignee: The Whitaker Corporation, Wilmington, Del.

[21] Appl. No.: 213,275

[22] Filed: Mar. 15, 1994

[30] Foreign Application Priority Data

Apr. 6, 1993 [GB] United Kingdom ..... 9307127

[51] Int. Cl.[6] ..... H01R 9/09

[52] U.S. Cl. ..... 439/79; 439/607

[58] Field of Search ..... 439/607, 717, 439/723, 714, 79, 736, 610, 609

[56] References Cited

U.S. PATENT DOCUMENTS

| | | | |
|---|---|---|---|
| 4,705,332 | 11/1987 | Sadilgh-Behzadi | 439/717 X |
| 4,715,830 | 12/1987 | DeLuca | 439/723 X |
| 4,836,791 | 6/1989 | Grabbe et al. | 439/79 |
| 4,846,727 | 7/1989 | Glover et al. | 439/608 |
| 4,921,436 | 5/1990 | Sole et al. | 439/736 X |
| 4,975,084 | 12/1990 | Fedder et al. | 439/608 |
| 5,046,960 | 9/1991 | Fedder | 439/108 |
| 5,066,236 | 11/1991 | Broeksteeg | 439/79 |
| 5,104,341 | 4/1992 | Glissen et al. | 439/608 |
| 5,314,350 | 5/1994 | Matthews et al. | 439/717 X |

FOREIGN PATENT DOCUMENTS 0337634 10/1989 European Pat. Off. .

*Primary Examiner*—Neil Abrams
*Assistant Examiner*—Daniel Wittels
*Attorney, Agent, or Firm*—Eric J. Groen; Mary K. Van Atten

[57] ABSTRACT

Module terminals comprising a column of right angle contacts are assembled to a housing module for receiving post header terminals at one end and inserted into complimentary holes of a printed circuit board on the other end. Interposed between adjacent terminal modules are shielding members that serve to limit crosstalk between adjacent rows of contacts. The shielding members are attached to overmoulded insulative webs of the terminal module and are resiliently biased thereagainst so that they ensure good contact of an integral grounding pin with one of the right angle contacts of the terminal module and also to ensure a flush fit of the grounding shield against the terminal module.

20 Claims, 7 Drawing Sheets

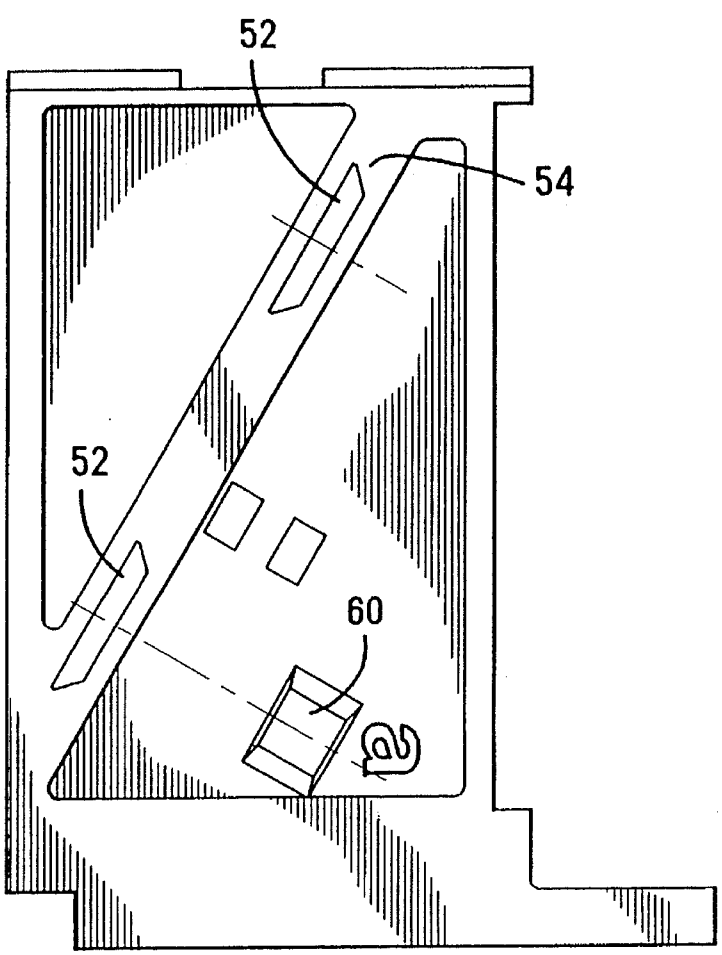
FIG. 3
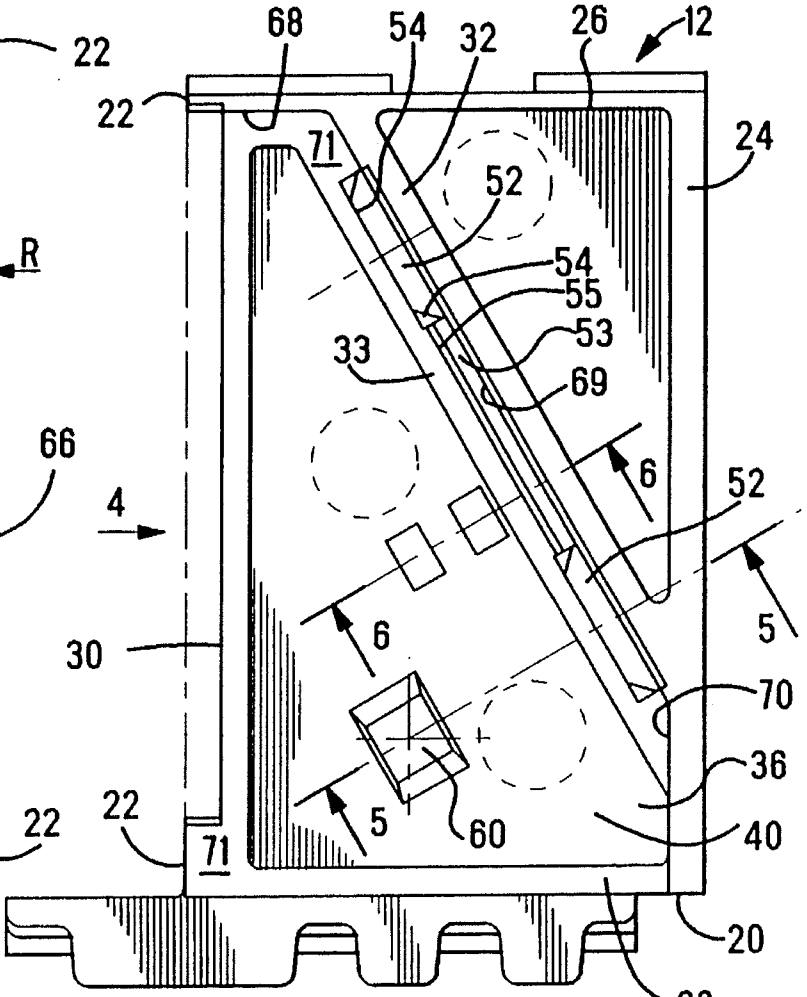
FIG. 2
FIG. 4

PRESTRESSED SHIELDING PLATES FOR ELECTRICAL CONNECTORS

BACKGROUND OF THE INVENTION

1. Field of the Invention

This invention relates to shielding plates that are mountable to terminal modules of an electrical connector assembly, serving to shield columns of adjacent terminals from crosstalk.

2. Description of the Prior Art

It is common, in the electronics industry, to use right angled connectors for electrical connection between two printed circuit boards or between a printed circuit board and conducting wires. The right angled connector typically has a large plurality of pin receiving terminals and at right angles thereto, pins (for example compliant pins), that make electrical contact with a printed circuit board. Post headers on another printed circuit board or a post header connector can thus be plugged into the pin receiving terminals, making electrical contact therebetween. The transmission frequency of electrical signals through these connectors is very high and requires not only balanced impedance of the various contacts within the terminal modules to reduce signal lag and reflection but also shielding between rows of terminals to reduce crosstalk.

Impedance matching of terminal contacts has already been discussed in document EP-A-0422785. Cost effective and simple designs of right angle connectors has also been discussed in EP-A-0422785, whereby the modular design makes it easy to produce shorter or longer connectors without redesigning and tooling up for a whole new connector, but only producing a new housing part into which a plurality of identical terminal modules are assembled. As shown in the aforementioned document, shielding members can be interposed between adjacent terminal modules. This requires however, either an insert to replace the shield or a thicker terminal module to take up the interposed shielding gap if the shielding is not required. The shielding disclosed in EP-A-0422785 has a pin receiving terminal end that is inserted into a housing module cavity, and a pin contact end for contacting the printed circuit board. This shield is relatively expensive to manufacture and assemble.

SUMMARY OF THE INVENTION

With respect to the above mentioned disadvantages, the object of this invention is to provide a simple, cost effective shield for mounting between terminal modules of a right angled connector assembly.

A further object of this invention, is to provide a shield that makes a reliable and effective electrical connection between a grounding circuit and the shield.

Yet another object of this invention is to provide a terminal module that can be assembled to a module housing with or without shielding, without requiring use of an insert or another terminal module.

An object of this invention has been achieved by providing a right angle electrical connector assembly for mounting to a printed circuit board, comprising an insulating housing and at least one terminal module having a plurality of contacts of which a portion is encapsulated by an insulative web, characterized in that the connector has prestressed electrically conductive shields that can be mounted to and held against the terminal modules by elastic deformation of the shield in cooperation with shield mounting means of the module.

Another object of this invention has been achieved by providing the aforementioned connector with a shield that is mounted substantially flush in a recess of the insulative web such that a plurality of modules can be assembled side by side with the insulative webs of adjacent modules contiguous.

Yet another object has been achieved by providing the aforementioned connector with a shield prestressed pin for electrical contact with a terminal module grounding contact through a hole in the insulative web, the pin being integral and stamped from a base of the shield and comprising a resilient Y-shaped spring; and projections extending below the shield base make electrical contact with the printed circuit board.

BRIEF DESCRIPTION OF THE DRAWINGS

FIG. 2 is a side view of the insulative web;

FIG. 3 is a view on the other side of the insulative web of FIG. 2;

FIG. 4 is a view in the direction of arrow 4 in FIG. 2;

DETAILED DESCRIPTION OF THE PREFERRED EMBODIMENT

Figure 1:
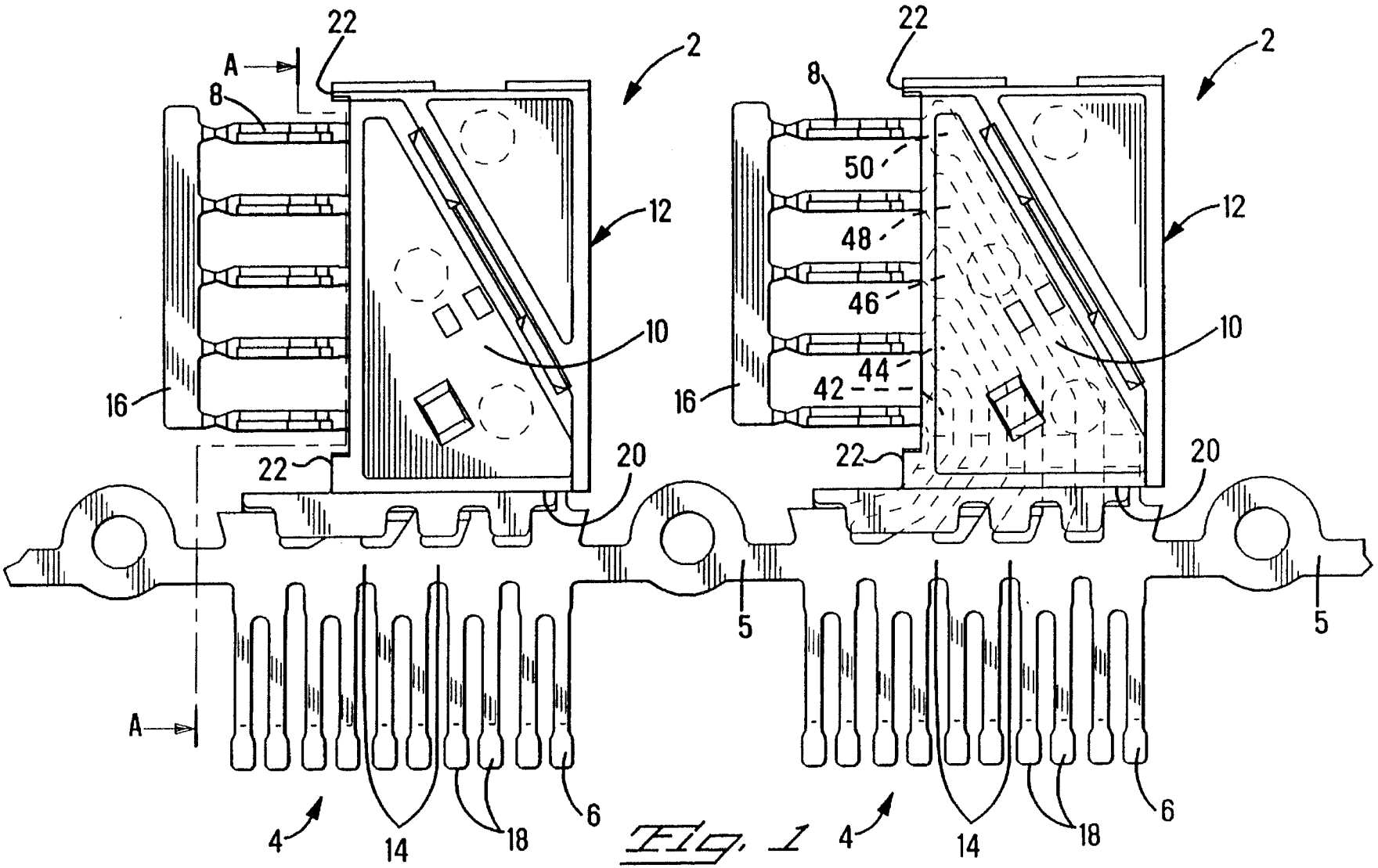
FIG. 1 is a side view of partially stamped and formed terminal modules with over molded insulative webs, whereby phantom lines show the portion of the terminals that are encapsulated by the web.

With reference to FIG. 1, a terminal module generally shown at 2 is only partially manufactured having a plurality of edge stamped contacts generally shown at 4 which are shown still connected to a carrier strip 5, the terminal contacts 4 having a mating contact portion 6 for mating with pin contacts and a conductor connecting portion 8 for connection to a printed circuit board, interconnected by an intermediate portion 10. The portions 6, 8 and 10 are formed from the same strip of sheet metal. After stamping of the contact portions 6, 8 and 10, as shown in FIG. 1, an insulative web generally shown at 12 is molded over the intermediate portions 10. Reinforcement strips 14 and 16 that help to support respectively contact portions 6 and 8, are maintained until after over-moulding of the insulative web 12 over the intermediate portions 10. During final manufacturing steps of the terminal module 2, the bridges 14 and reinforcement strip 16 are then cut away, producing the terminal shown in FIG. 10. Another manufacturing step required for completion of the terminal 2 of FIG. 1, is the twisting of adjacent pin receiving contacts 18 by approximately 90 degrees such that the contact surfaces 18 face each other for reception of a mating pin terminal.

Figure 10:
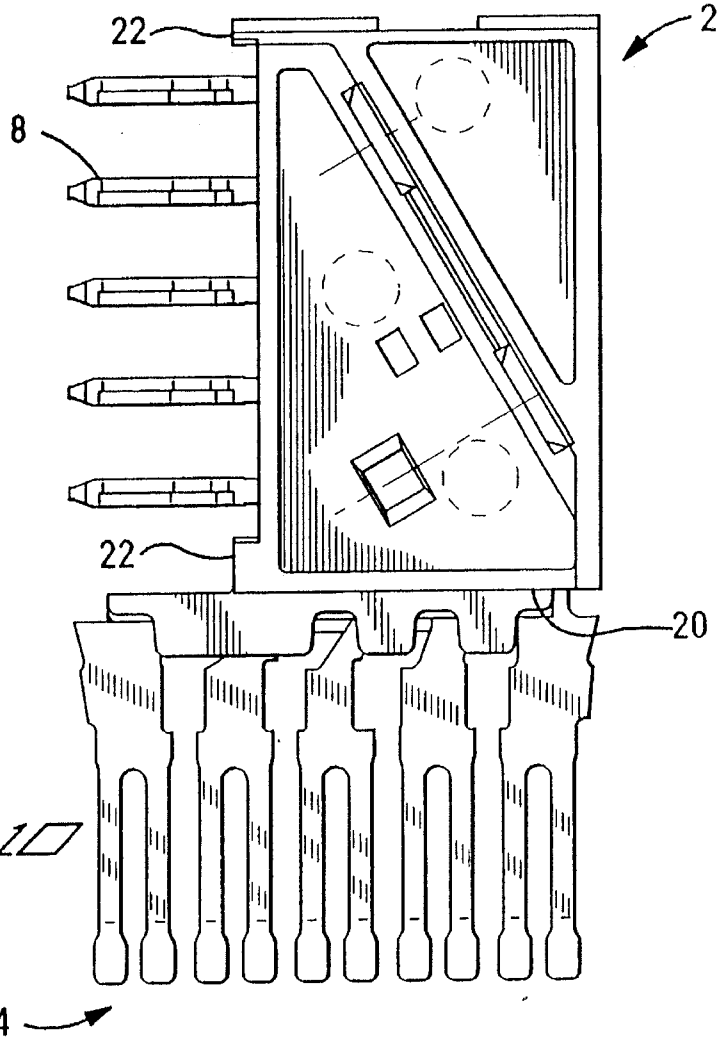
FIG. 10 is side view of a loose piece terminal module without shield.
Figure 11:
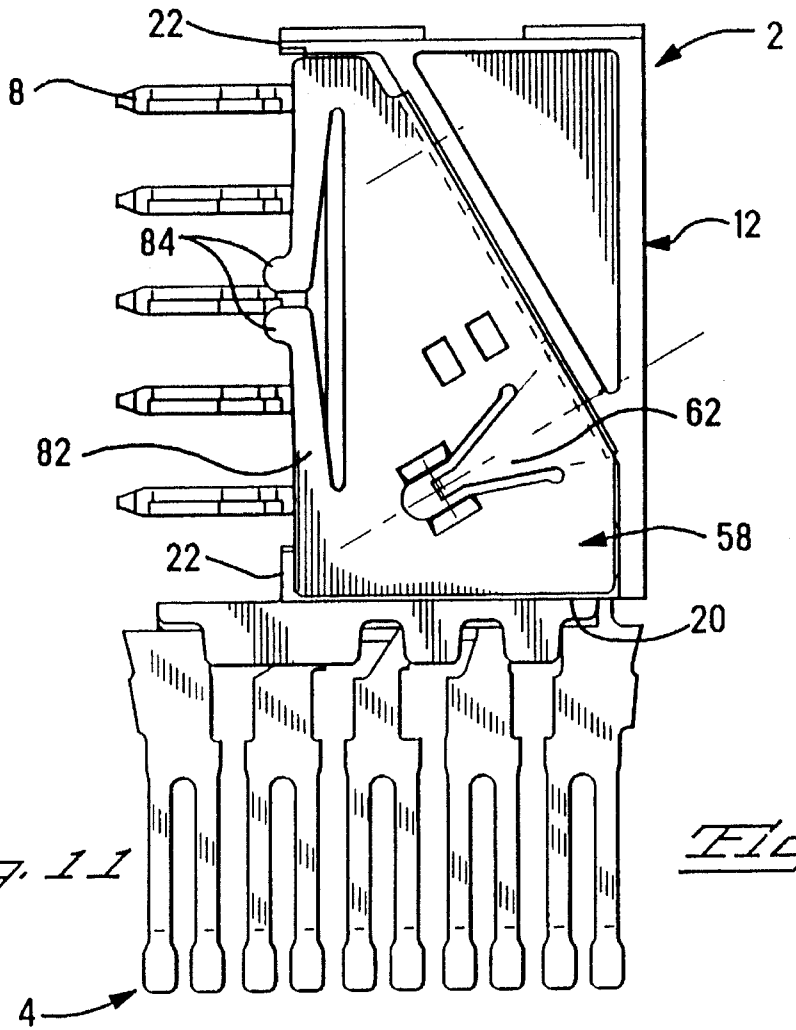
FIG. 11 is a side view of a loose piece terminal module with a shield attached thereon.
Figure 12:
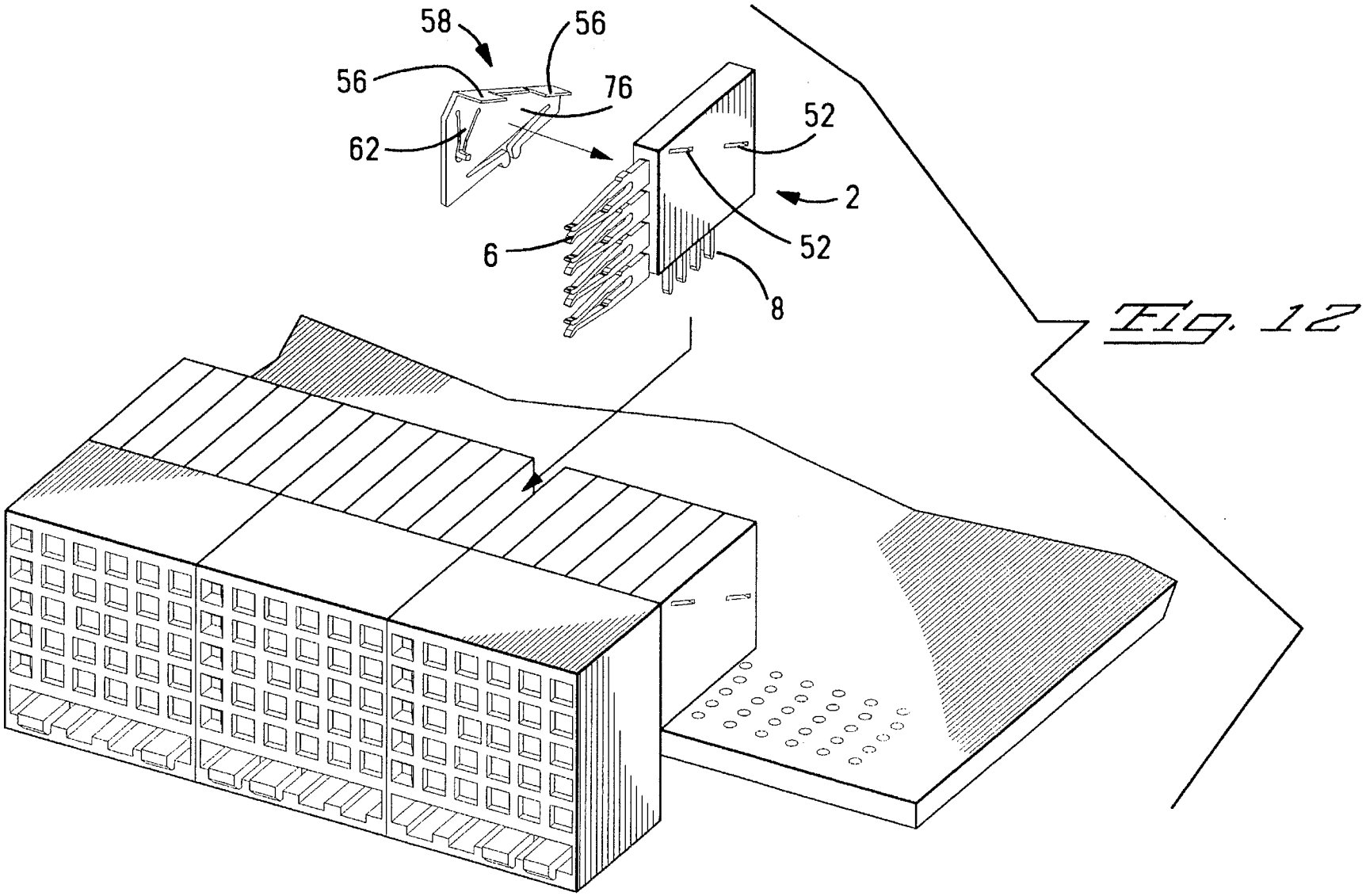
FIG. 12 is an isometric view showing the electrical connector assembly with an exploded away terminal module, the shield exploded away, and a plurality of terminal modules assembled to a housing.

The terminal modules 2 of FIG. 10 and 11 are then inserted into the back of housing modules as disclosed in EP-A-0273589, whereby the pin receiving end 6 is for receiving a complementary male pin terminal and the pin terminal end 8 is for electrical contact with pin receiving holes of a printed circuit board. When assembled to a housing and a printed circuit board, the insulative web 12 of the module 2 abuts on a forward surface 20 against the rear of the housing, and abuts the printed circuit board with surfaces 22.

Figure 5:
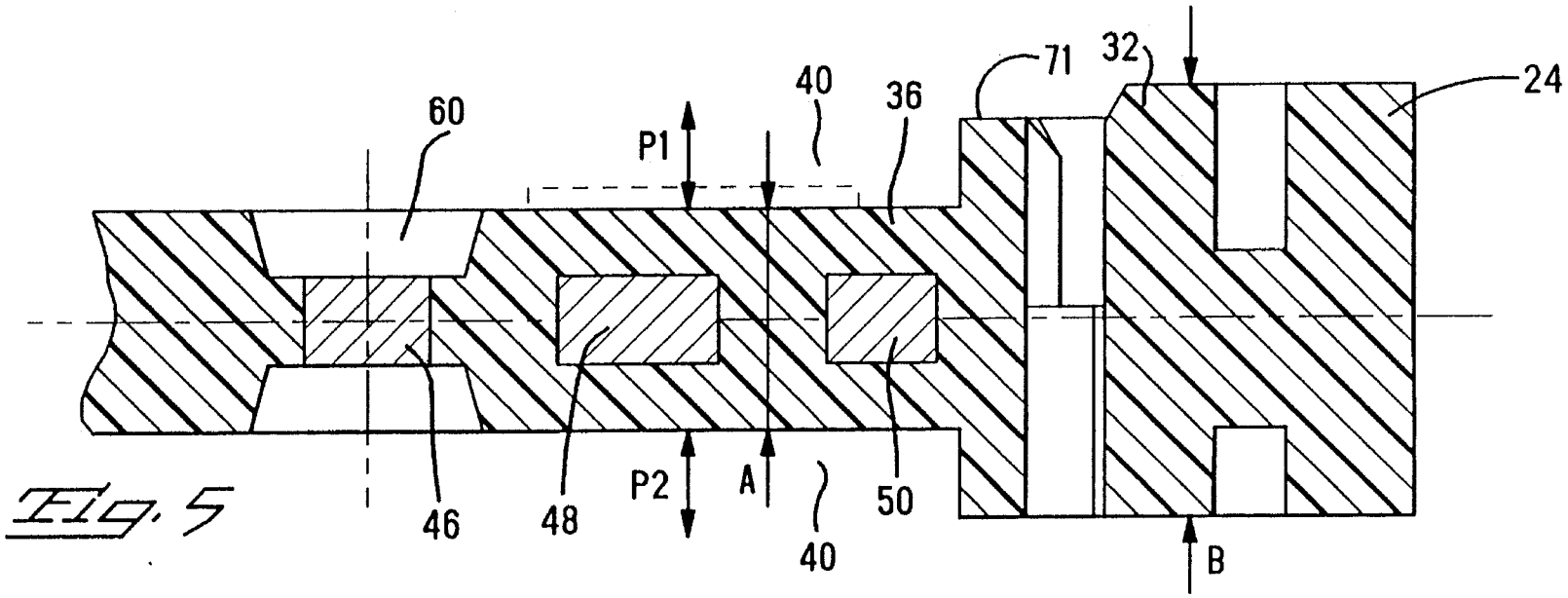
FIG. 5 is a cross sectional view through lines 5—5 of FIG. 2.
Figure 6:
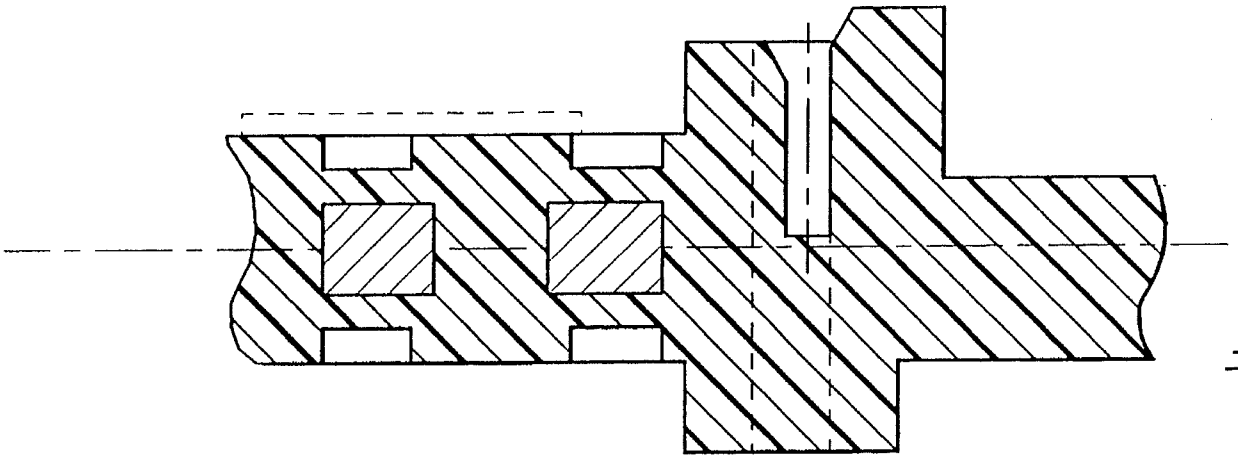
FIG. 6 is a cross sectional view through lines 6—6 of FIG. 2.

With reference to FIGS. 2, 3 and 4, the insulative over molded web 12 is shown for better clarity without the contacts, comprising a top wall 24, a back wall 26, a front wall 28, a bottom wall 30 and an intermediate diagonal wall 32. The diagonal wall 32 includes a recessed wall portion 33, which will be described more fully herein. The diagonal, front and bottom walls 32, 28, 30 enclose an area in which the intermediate portions 10 of the contacts are encapsulated by the over-moulded dielectric material, whereby this over-moulded dielectric layer 36 is thinner than the walls 32, 30, 28 as shown in FIG. 5, where A is the thickness of the encapsulated dielectric 36 and B the thickness of the wall 32. As shown in FIG. 5 the difference between the thicknesses A and B creates two air pockets 40 on either side of the web 36 with thicknesses P1 and P2. Because of the right angled configuration of the terminal module 2, the intermediate contact portions 10 (FIG. 1) have different lengths, the different lengths of the contacts mean that they have different impedances which is undesirable for high speed data transmission, this being explained in more detail in EP-A-0422785. The air pockets 40 serve to decrease the dielectric constant between contacts, and match the impedance of the contacts 10 with respect to each other, for the same reasons as disclosed in the aforementioned document.

Briefly resuming the latter: It is desirable to increase the speed of signal transmission in the outer contacts 48, 50 and to decrease the speed of the inner contacts 42, 44 so as to match signal speed transmission of outer and inner contacts thereby avoiding undesirable signal lag therebetween. This is done on the one hand by increasing the length of the intermediate portion of the inner contacts (FIG. 1) and on the other hand decreasing the dielectric constant of the outer contacts 48, 50. The former is done by displacing the contacts to the left (of FIG. 1) such that the outer contacts 48, 50 have as direct a path as possible between portions 6 and 8, whereby intermediate portions 10 of contacts 42, 44 have to bend around in an approximately reversed C-shape from the portion 6 to the portion 8; and the latter is done by exposing a long intermediate portion 10, of the contact 50, to a pocket of air 40, the air having a lower dielectric constant than the material of the insulative web, whereby the inner contacts 42, 44 are exposed along a much shorter length to the pocket of air 40. In the preferred embodiment, the intermediate portions 10 are not actually directly exposed to the pocket of air 40, but covered with a layer 36 of insulating material as this is easier to manufacture, protects, and provides better structural support for the intermediate portions 10. This does not however change the principal under which the air pocket affects the impedance of the contacts 42 to 50.

Once again referring to FIG. 2, the molded insulative web 12 is shown comprising mounting holes 52 in the diagonal wall 32 and having interference fit protrusions 54 that extend from roughly halfway within the mounting through hole 52 to the end thereof as shown in FIG. 3. The mounting holes 52 receive tab mounts 56 of a shield 58 (FIGS. 7,8), whereby the interference protrusions 54 cooperate with edges 57 of the mounts 56 for secure fastening of the shield 58 thereto. A grounding cavity 60 in the insulative web layer 36, is provided to allow electrical contact of a resilient grounding pin 62 of the shield 58 (FIG. 7) with one of the contacts, namely contact 46 at an intermediate portion 10 (also see FIGS. 1, 5). The over-moulded insulative web 12 also has a recess 66 (FIG. 4) defined by the contours 68, 69, 70 (FIG. 2) which has a thickness R essentially the same thickness as the shield 58. It should be noted in FIG. 2, that the walls 28, 30 and 33 have a common planar surface 71, which is shown in both FIGS. 2 and 5. The shield outer contour 72, 73, 74 (FIG. 7) is substantially the same as, respectively, the interior contour formed by surfaces 68, 69, 70 of the insulative web 12 and can therefore be mounted to the web (FIG. 11) by means of the mounts 56 and corresponding mounting holes 52, such that the shield is within the recess 66 and the exterior surface flush to the exterior surface 71. The terminal modules 2 can thus be assembled side by side to a housing module as described in EP-A-0422785 FIG. 1 such that the walls 24, 26, 32 are contiguous to corresponding walls 24, 26, 32 of an adjacent terminal module 2.

Figures 7, 8:
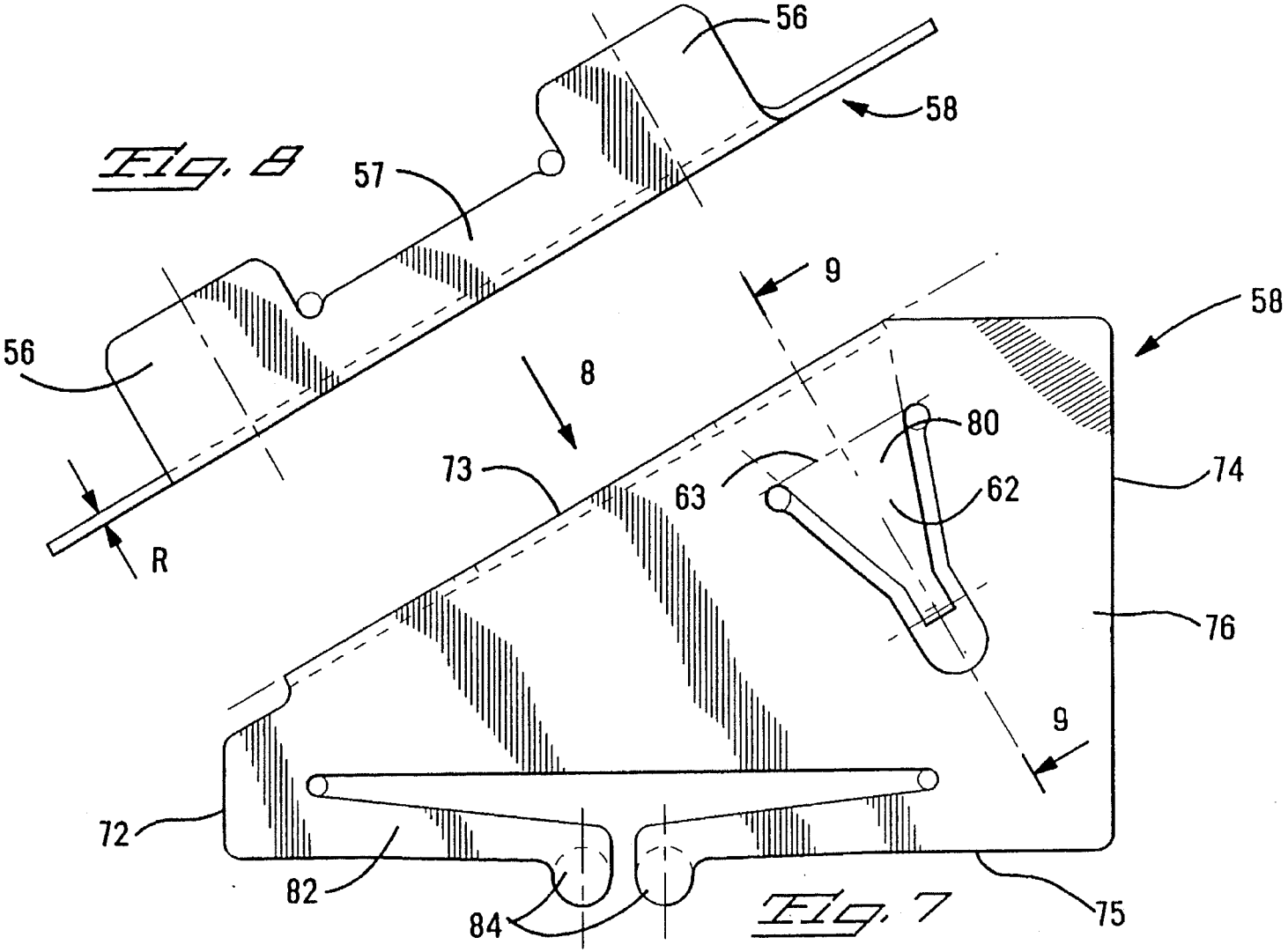
FIG. 7 is a plan view of a shield that is attached to the insulative web of FIGS. 2, 3 and 4.
FIG. 8 is a view in the direction of arrow 8 in FIG. 7.

As seen in FIG. 7, the shield 58 has a planar base 76 defined by the contours 72, 73, 74 and 75, and as already mentioned, the base 76 of the shield 58 fits within the recess 66 of the over-moulded web 12, whereby the base 76 spans almost the entire surface of the contact intermediate portion 10 in order to provide a electrically conductive shield separating adjacent terminal modules 2 of a housing assembly. This interposed shielding serves to limit unwanted crosstalk between contacts of adjacent terminal modules. Shielding elements interposed between adjacent terminal modules is already known and disclosed for example in EP-A-0422785, whereby the shield element 180 disclosed therein performs substantially the same function as the shield of this present invention, but hasn't got the constructional advantages nor the effectiveness of the electrical grounding of the present invention as will be seen more clearly hereinafter.

Figure 9:
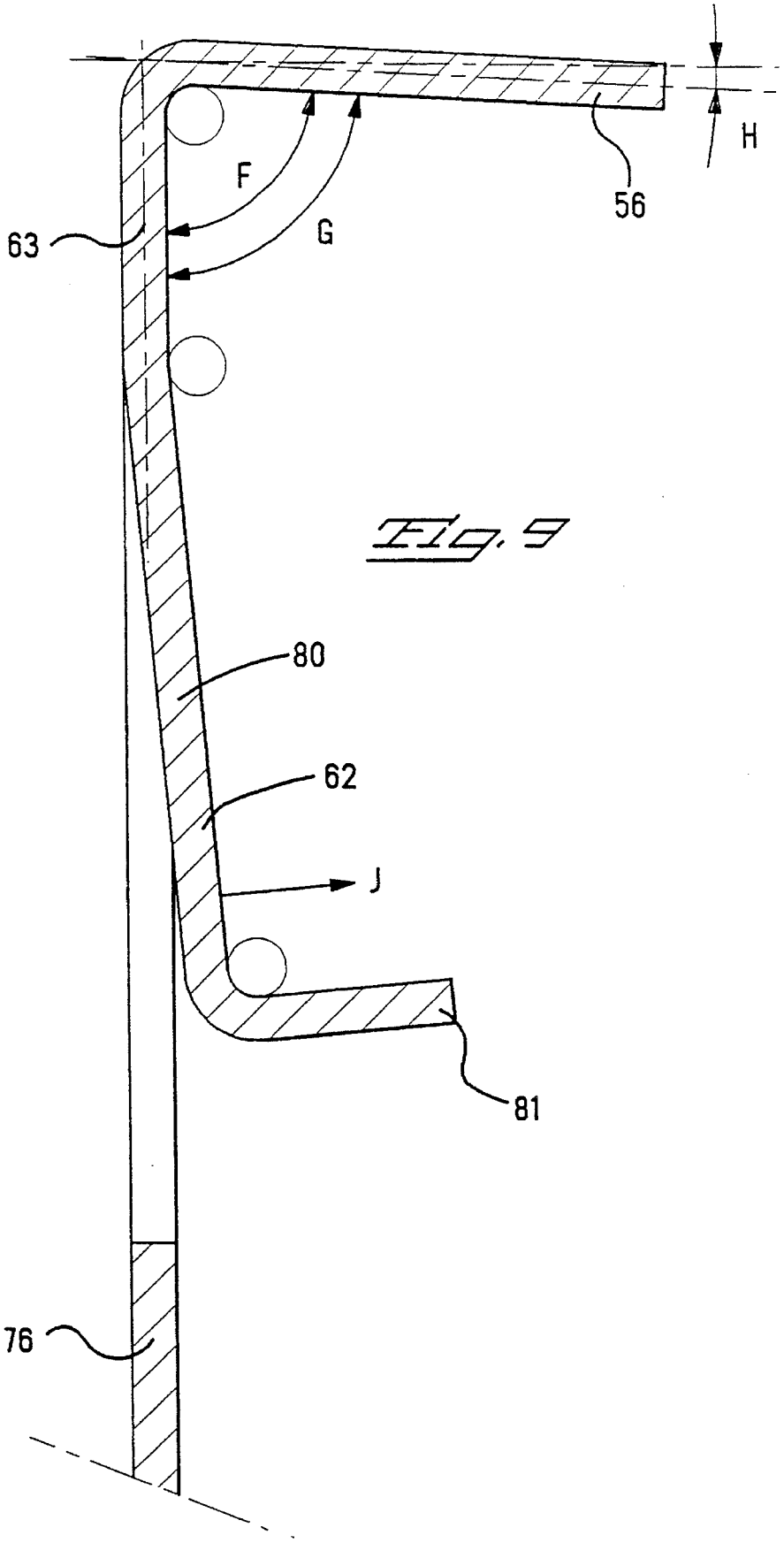
FIG. 9 is a cross sectional view through lines 9—9 of FIG. 7.

The shield 58 will now be described in more detail with reference to FIGS. 7, 8 and 9. As already mentioned the mounts 56 are inserted in an interference fit in the mounting holes 52 with the interference projections 54, the mounts 56 being bent at an angle F to the planar base whereas the mount can only be fully inserted into the mounting slot 52 by resiliently biasing the mounts 56 outwards by an angle H such that the mount forms an angle G (equal to F+H) with the planar base 76. The shield planar base 76 is thus maintained resiliently against the walls 28 and 30 of the insulative web 12, which ensures that the planar base 76 is not only held securely against the over-moulded web 12 but also remains flush to the walls 24, 26, 32 and additionally ensures that the grounding pin 62 is firmly pressed against the contact 46 (through the cavity 60) in order to make good electrical contact therebetween, without lifting planar base 76 away from wall 28 and 30. More particularly, and with respect to FIG. 9, the grounding pin 62 is interconnected to the plate 76 by a root 63, which is proximate to the upper tabs 56. Thus, when the tabs are inserted into their respective retaining openings 52, the tabs 56 and plate move through the angle H. This movement of the tabs 56 upwardly, causes the contact 62 to rotate in the direction J, thereby further preloading the contact tip 81 against the ground intermediate portion 46. The grounding pin 62 has a Y-shaped spring section 80 and a contact tip 81 for contacting the contact 46 as can be seen in FIG. 9, the spring section 80 being inclined slightly inwards with respect to the planar base 76 in order to increase the resilient force with which the contact tip 81 is pressed against the contact 46. The Y-shape of the spring provides for a strong attachment of the spring to the base 76 and yet has the required flexibility due to the decreasing width towards the contact tip 81.

Extending from the bottom 75 of the planar base 76 are two arms 82 and integral contact projections 84 for making contact with grounding circuit traces of the printed circuit board. When the shield 58 is mounted to the terminal module 2, the shield projections 84 extend below the plane defined by the surfaces 22 of the molded web 12, the surfaces 22 resting against the printed circuit board surface when the module 2 is mounted thereon, thus resiliently biasing the shield contact projections 84 against the printed circuit board to make contact therewith.

Advantageously, the grounding pin 62 and grounding arms 82 act as an electrical "drain" between the shield and the common ground circuit of the various interconnected printed circuit boards and electrical devices whereby the effectiveness of this drain is determined by the length and resistance of the electrical path between the shield and ground circuit, by the number of electrical contacts therebetween, and by the optimal distribution of these contact points so as to cover the shield surface in the most evenly spread manner. By having the two grounding arms 82 and the grounding pin 62, and by additionally having the grounding pins 62, 82 not only spread out but also as short and wide as possible (Y-shape) for a small electrical resistance and short electrical path to the shield, one provides a very effective drain between the shield and ground circuit. Furthermore, by providing the tabs 56 at an angle F with respect to the plate member 76, the movement of the tabs 56 through the angle H causes secure attachment of the crosstalk shield 58 to the molded web 12, as well as preloads the contact tip 82 against the intermediate contact 46.

Finally, between the mounts 56 is an intermediate mount 57 that cooperates in an interference fit with an intermediate slot 53 of the moulded web 12, whereby the interference is provided by reducing the thickness of the slot with a ridge 55. This additional mounting means 57 helps to fasten the prestressed shield 58 more securely against the moulded web 12.

The preferred embodiment described above makes reference to shielding for right angled, impedance matched modular connectors for mounting to a printed circuit board. This, however, should not be limiting to the disclosed invention relating to advantageous shielding means whereby many different types of connectors, not only for mounting to a printed circuit board, can be imagined without departing from the spirit of this invention.

We claim:

1. An electrical connector assembly comprising an insulating housing and assembled thereto a plurality of terminal modules and electrically conductive shields inserted between adjacent terminal modules, each terminal module having a plurality of contacts including a mating contact portion, a conductor connecting portion and an intermediate portion therebetween, the connector assembly characterized in that the terminal module has an insulative web that encapsulates some or all of the intermediate portion; and the electrically conductive shield has a mounting member that is engageable with a complementary mounting member of the terminal module, the shield being prestressed such that when the mounting member and the complementary mounting member are engaged, the shield is held resiliently against the terminal module due to elastic deformation of the shield.

2. The connector of claim 1 characterized in that the shield has a substantially planar base that forms a first angle with the shield mounting member when the shield is not mounted to the terminal module, and the base can be elastically bent by an additional angle away from the mounting member such that the base forms a second angle equal to the first angle plus the additional angle when the shield is mounted to the terminal module.

3. The connector of claim 1 characterized in that the complementary mounting member is a receiving slot in the insulative web and the shield has a substantially planar base and at least one prestressed mount that can be resiliently bent for mounting in the receiving slot, such that the shield is fixedly held to the terminal module and the planar base resiliently biased thereagainst.

4. The connector of claim 1 characterized in that the shield is fixedly held to the terminal module by interference fit between the mounting member and the complementary mounting member.

5. The connector of claim 3 characterized in that the slots include protrusions, the protrusions cooperating with the mounting member to form the interference fit therebetween.

6. The connector of any one of claims 1–5 characterized in that the insulative web includes a recess and the shield is mounted substantially flush therein such that a plurality of modules can be assembled side by side with the insulative webs of adjacent modules contiguous.

7. The connector of claim 1 characterized in that the shield has a resilient prestressed grounding pin for electrical contact with one of the terminal module contacts.

8. The connector of claim 7 characterized in that the insulative web has a hole such that the grounding pin electrically contacts one of the terminal module contacts therethrough.

9. The connector of claim 8 characterized in that the grounding pin is integral and stamped from a planar base of the shield and comprises a Y-shaped spring section with a contact tip bent therefrom that is resiliently biased against the corresponding terminal module contact.

10. The connector of claim 9 characterized in that the shield planar base has at least one resilient arm having a grounding projection stamped therefrom and that extends to the printed circuit board to make electrical contact therewith when the module is assembled thereto.

11. The connector of claim 10 characterized in that the arm and the grounding projection is in the same plane as the base.

12. The connector of claim 11 characterized in that the shield planar base has two resilient arms with their corresponding grounding projections.

13. The connector of claim 12 characterized in that the shield has a roughly triangular shape that spans the portion of contacts encapsulated by the insulative web.

14. An electrical connector assembly comprising:

a plurality of adjacently disposed terminal modules, where each module includes a plurality of contacts having a mating contact portion, a conductor connecting portion and an intermediate portion therebetween, and an insulative web encapsulating at least a portion of the intermediate portion, the insulative web including a complementary mounting member; and a shield member having a mounting member resiliently extending from a base at a first angle, where the mounting member is received by the complementary mounting member of the web, such that when the shield member is fully seated the base is biased against the web by the resiliency of the mounting member, where the mounting member is now disposed relative the base at a second angle that is different than the first angle.

15. The electrical connector of claim 14, wherein the complementary mounting member is a slot extending into the web and the web includes a surface upon which the base of the shield is disposed, where the slot and the surface are angled to one another by the second angle.

16. The electrical connector of claim 15, wherein the shield further includes a resilient contact projection extending from the base for engaging a circuit trace of a printed circuit board.

17. The electrical connector of claim 16, wherein the base includes a grounding pin cantilevered therefrom and the web includes a corresponding opening for receiving the grounding pin so that the grounding pin establishes an electrical interconnection with the intermediate section of one of the contacts.

18. The electrical connector of claim 14, wherein the shield is generally triangular in shape having at least one edge corresponding to the mating contact portion and one edge corresponding to the conductor connecting portion, where these edges are interconnected by a spanning edge to define the base of the shield, the mounting members extend from the spanning edge at the first angle thereto, and the web includes a recess wherein the shield is disposed so that the insulative webs of adjacent modules can be placed in an abutting relation.

19. The electrical connector of claim 14, wherein the shield base of the shield has a planar form.

20. The electrical connector of claim 14, wherein the complementary mounting member includes a projection that interacts with the mounting member to anchor the mounting member therewith.

* * * * *